US007713074B2

(12) United States Patent
Poo et al.

(10) Patent No.: US 7,713,074 B2
(45) Date of Patent: May 11, 2010

(54) PORTABLE DATA STORAGE APPARATUS WITH CONNECTOR RETRACTION

(75) Inventors: Teng Pin Poo, Singapore (SG); Henry Tan, Singapore (SG)

(73) Assignee: Trek 2000 International Ltd, Singapore (SG)

( * ) Notice: Subject to any disclaimer, the term of this patent is extended or adjusted under 35 U.S.C. 154(b) by 27 days.

(21) Appl. No.: 11/993,455

(22) PCT Filed: Dec. 21, 2006

(86) PCT No.: PCT/SG2006/000402

§ 371 (c)(1),
(2), (4) Date: Dec. 20, 2007

(87) PCT Pub. No.: WO2008/004979

PCT Pub. Date: Jan. 10, 2008

(65) Prior Publication Data

US 2008/0318475 A1 Dec. 25, 2008

(51) Int. Cl.
*H01R 13/44* (2006.01)

(52) U.S. Cl. ..... 439/136; 439/147

(58) Field of Classification Search ..... 439/136, 439/142, 143, 144, 147
See application file for complete search history.

(56) References Cited

U.S. PATENT DOCUMENTS

| | | | | |
|---|---|---|---|---|
| 6,456,500 | B1 * | 9/2002 | Chen | 361/752 |
| 6,926,544 | B2 | 8/2005 | Lee | |
| 6,932,629 | B2 * | 8/2005 | Ikenoue | 439/138 |
| 7,179,099 | B2 * | 2/2007 | Hsieh | 439/131 |
| 7,500,858 | B2 * | 3/2009 | Emerson et al. | 439/136 |
| 2007/0063249 | A1 * | 3/2007 | Rambosek et al. | 257/315 |

FOREIGN PATENT DOCUMENTS

EP 1 703 782 A1 9/2006

* cited by examiner

*Primary Examiner*—Thanh-Tam T Le
(74) *Attorney, Agent, or Firm*—Blakely, Sokoloff, Taylor & Zafman LLP

(57) ABSTRACT

Portable data storage apparatus includes a housing having a front wall, and an opening in the front wall. A circuit board is located within the housing. A connector is electrically connected to the circuit board and extends outwardly therefrom for movement therewith. A cap is pivotally connected to the housing for movement relative to the housing between a first position and a second position. An operating mechanism operatively connects the cap and the circuit board for moving the circuit board and the connector with the movement of the cap. The circuit board and the connector are in a retracted position when the cap is in the first position, and are in an extended position when the cap is in the second position.

19 Claims, 4 Drawing Sheets

PORTABLE DATA STORAGE APPARATUS WITH CONNECTOR RETRACTION

CROSS-REFERENCE TO OTHER APPLICATIONS

This is a National Phase of International Application No. PCT/SG2006/000402, filed on Dec. 21, 2006.

FIELD

This invention relates to portable data storage apparatus with connector retraction and refers particularly, though not exclusively, to a USB flash drive with connector retraction where the connector cap operates the retraction mechanism.

BACKGROUND

USB flash drives are now quite popular for data storage and transfer, authentication, and so forth. The normal construction has a body with a connector extending from the body. A releasable cap covers the connector when the USB flash drive is not in use. The cap may be a separate component, or may be attached to the body. However, caps become lost, or may be accidentally removed from the cover or connector and the connector can be damaged. This renders the USB flash drive virtually useless.

SUMMARY

According to a preferred aspect there is provided portable data storage apparatus comprising:

- a housing having a front wall, and an opening in the front wall;
- a circuit board located within the housing;
- a connector electrically connected to the circuit board and extending outwardly therefrom for movement therewith;
- a cap pivotally connected to the housing for movement relative to the housing between a first position and a second position;
- an operating mechanism operatively connecting the cap and the circuit board for moving the circuit board with the movement of the cap, the circuit board and the connector being in a retracted position when the cap is in the first position, and are in an extended position when the cap is in the second position.

The operating mechanism may comprise at least one pin engaging in at least one track, the at least one pin passing through at least one opening in the housing. The circuit board may be mounted within a cover, the connector being physically connected to at least one of: the circuit board, and the cover. The cover may have a top surface, and the top surface may comprise the at least one track. The at least one track may comprise an annular track. The annular track may be undercut, and the at least one pin may have a bulbous head for engaging in and being retained by the annular track.

Additionally or alternatively, the cover may have a lower surface, and the lower surface may comprise the at least one track. Further alternatively, the circuit board may comprise the at least one track. The at least one track or the at least one opening may be at an angle of inclination to a central longitudinal axis of the housing. The angle of inclination may be in the range 30° to 60°, preferably 45°.

The cap may be generally U-shaped and may comprise an upper arm pivotally connected to a top wall of the housing, a lower arm pivotally connected to a bottom wall of the housing, an end integral with and extending between the upper arm and the lower arm, and an open end.

The at least one pin may extend downwardly from the upper arm, upwardly from the lower arm, and downwardly from the upper arm and upwardly from the lower arm. When the connector is in the extended position, the connector may pass through the opening in the front wall. When the connector is in the retracted position an outer end of the connector may be located: within the housing, or in the opening in the front wall.

The housing may further comprise a plurality of sliders on which the circuit board or the cover can slide between the retracted position and the extended position. The connector may be a USB connector or an IEEE1394 connector. The circuit board may comprise non-volatile memory.

The cap may have a cam or over-centre action when moving into and out of the first and second positions for providing tactile feel of engagement and disengagement respectively. The cap may require a small force to pass over front corner edges at junctions of side walls of the housing with the front wall of the housing, and rear corner edges at junctions of the side walls of the housing with a rear wall of the housing. The at least one pin may form a pivot connection between the cap and the housing.

BRIEF DESCRIPTION OF THE DRAWINGS

In order than the invention may be fully understood and readily put into practical effect there shall now be described by way of non-limitative example only exemplary embodiments, the description being with reference to the accompanying illustrative drawings.

In the drawings.

DETAILED DESCRIPTION OF THE EXEMPLARY EMBODIMENTS

Figure 1:
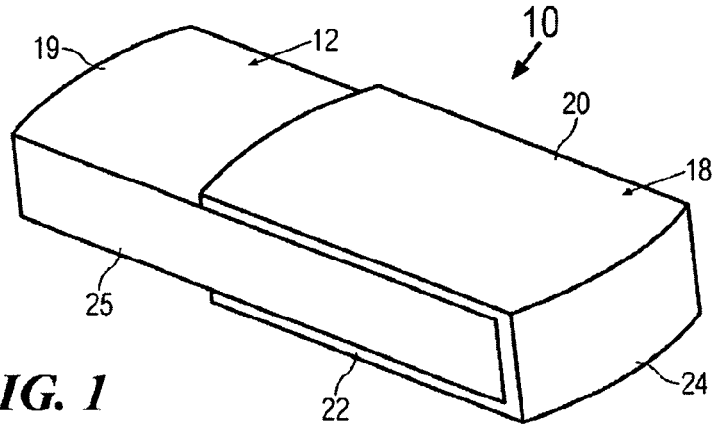
FIG. 1 is a front perspective view of an exemplary embodiment in a first position.

In the drawings there is shown a portable data storage apparatus 10. The portable data storage apparatus 10 has non-volatile data storage such as, for example, flash memory, a disk drive, and so forth. The apparatus 10 has a housing 12 and a USB connector 14 that passes through an opening 16 in a front wall 17 of the housing 12. The connector 14 may be a USB connector or a connector according to the IEEE standard 1394—a "Firewire" connector. All reference to a USB connector is to be taken as including a reference to a "Firewire" connector.

A generally U-shaped cap 18 is pivotally connected to the housing 12 by a pivot connection 26 to the top wall 19 and/or a pivot connection 27 to the lower wall 21 of the housing 12. The cap 18 has an upper arm 20, a lower arm 22, an end integral with and extending between the upper arm 20 and the lower arm 22, and an open end 42.

Figure 4:
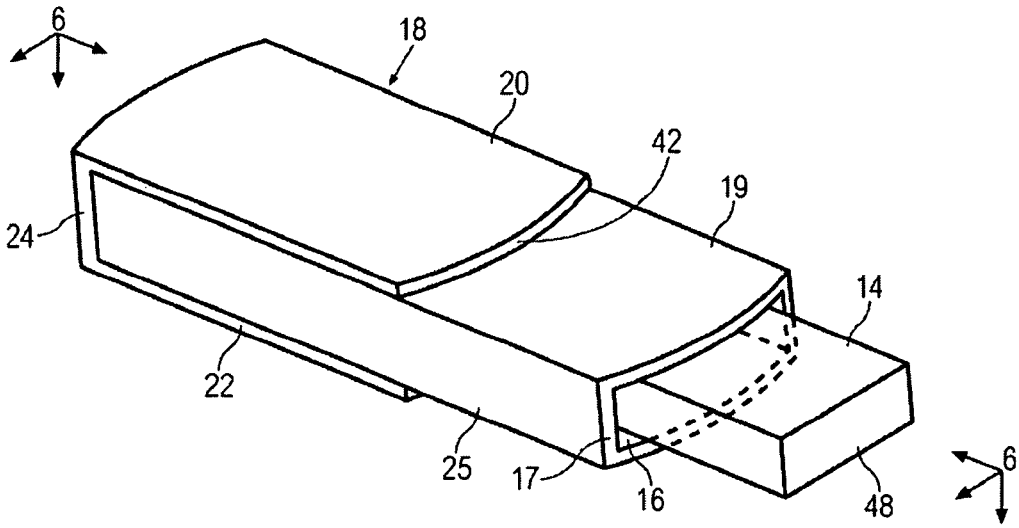
FIG. 4 is a front perspective view of the exemplary embodiment in a second position.
Figure 5:
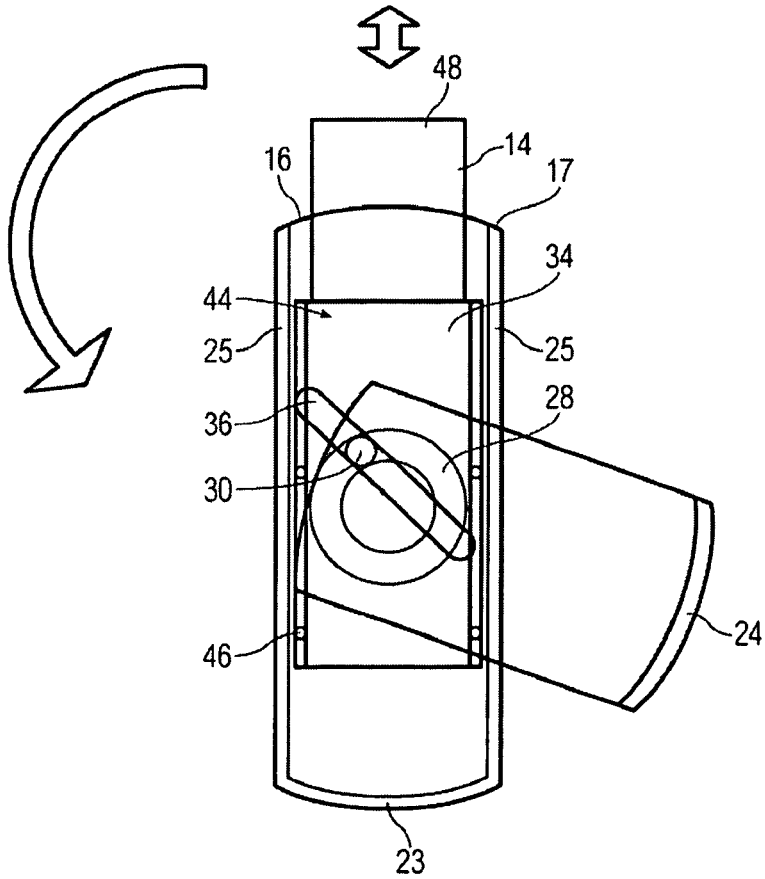
FIG. 5 is a transparent top view of the exemplary embodiment.
Figure 6:
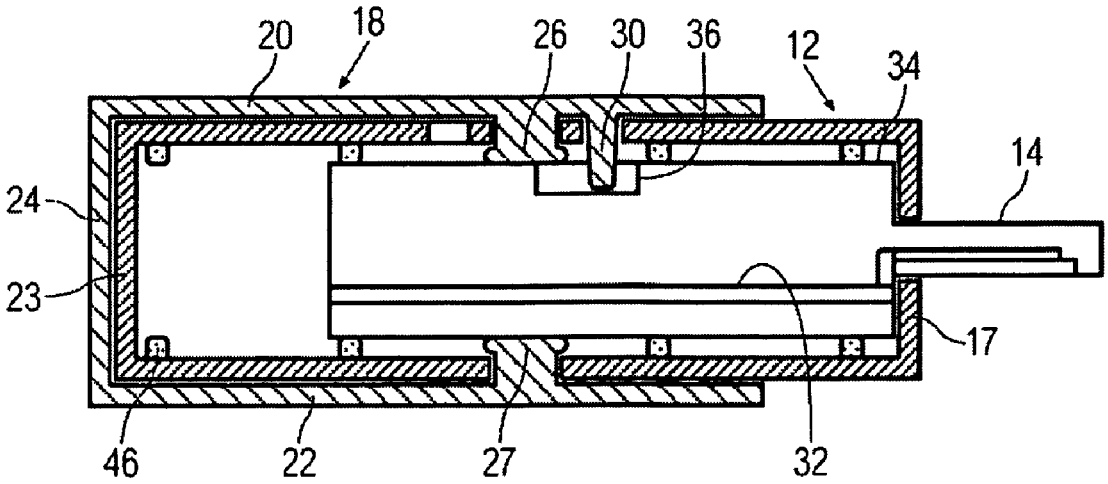
FIG. 6 is a longitudinal cross section along the line and in the direction of arrows 6-6 on FIG. 4.
Figure 7:
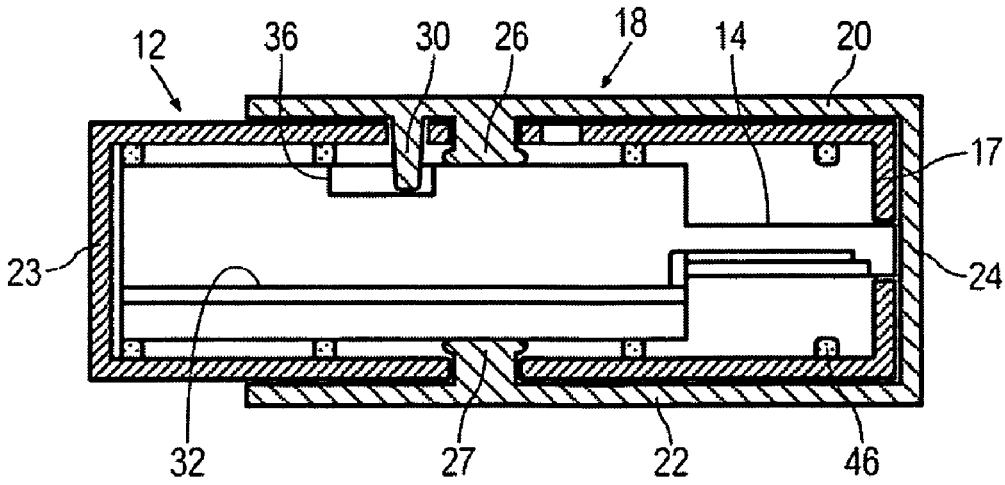
FIG. 7 is a view corresponding to FIG. 6 but in the first position

The cap 18 is able to move from a first position (shown in FIG. 1) by a pivoting movement to a second position (shown in FIG. 4). In the first position, the end 24 of the cap 18 covers end 17 and opening 16, as well as the connector 14. When in the first position the end 24 of the cap 18 covers and protects the connector 14. In the second position, the end 24 of the cap 18 does not cover the front wall 17, and the connector 14. As such the connector 14 is able to be used in the normal manner. When in this position, the end 24 of the cap 18 is located over the rear wall 23, the rear wall 23 being opposite the front wall 17.

The connector 14 is operatively and physically connected to a circuit board 32 that contains the operating electronics for the apparatus 10 (including non-volatile memory such as, for example, a disk drive and/or flash memory), and extends axially outwardly therefrom. The circuit board 32 may be contained within a cover 34, if required or desired. If there is a cover 34, the connection of the connector may be electrically to the circuit board 32 and physically to the cover 34 and/or the circuit board 32. An operating mechanism generally designated as 40 interconnects the cap 18 with the cover 34 or, if there is no cover 34, the circuit board 32.

In the exemplary embodiment the cap 18 has a pin 30 extending downwardly from a lower surface of the upper arm 20 of the cap 18 to the interior of the housing 12. The pin 30 is located between the pivot connection 26 of the cap 18 to the housing 12, and the open end 42 of the cap 18. If required or desired, there may be a second pin (not shown) extending upwardly from an upper surface of the lower arm 22 of the cap 18 to the interior of the housing 12. The second pin would be located between the pivot connection 27 of the cap 18 to the housing 12, and the open end 42 of the cap 18.

The pin 30 extends through at least one opening 28 in the top wall 19 of the housing 12 and engages in a track 36 formed in or on the top surface 44 of cover 34. If there is no cover, the track 36 would be in a member attached to the circuit board 32. The track 36 is inclined to the central, longitudinal axis of the top wall 17 of the housing 12 at an angle that is preferably in the range 30° to 60°, more preferably being 45°. If there is a second pin, it would pass through second openings in the housing 12, and engage in a second track. It would be, in effect, a mirror image of the pin 30 and track 36. The opening 28 will be arcuate and may cover an extended angle of movement to allow the cap to be moved between the first and second positions.

Figure 2:
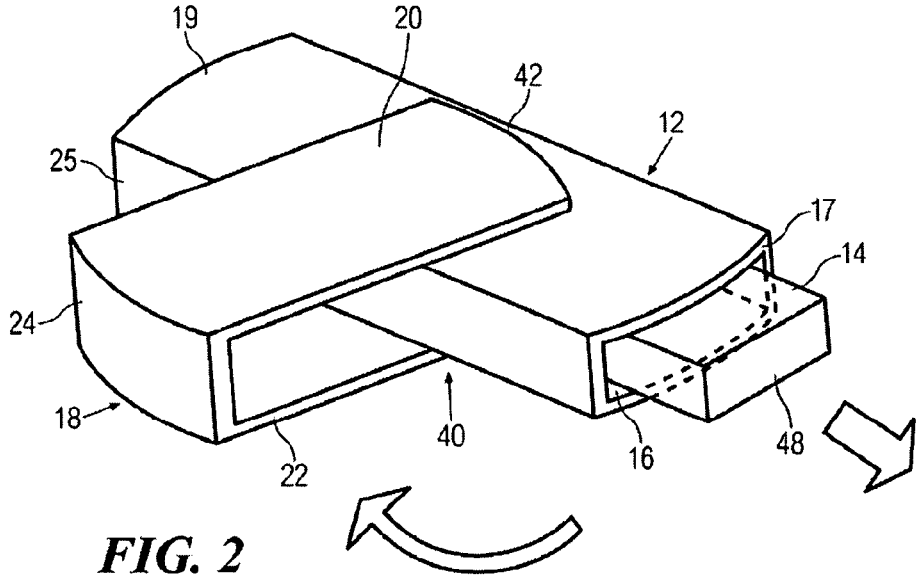
FIG. 2 is a front perspective view of the exemplary embodiment in an intermediate position.
Figure 3:
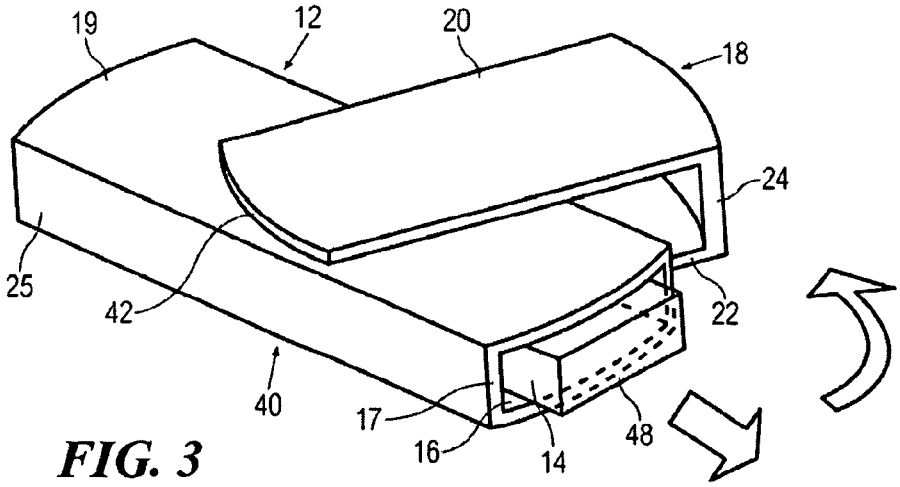
FIG. 3 is a front perspective view of the exemplary embodiment in another intermediate position.

In this way, when the cap 18 is moved in a pivoting manner about the pivots 26, 27 the pin 30 will press against the side walls of the track 36 and force the cover 34, or the circuit board 32, to move in the direction of the central, longitudinal axis of the cover 34. The movement may be clockwise (FIG. 2) or anticlockwise (FIG. 3) to move from the first position shown in FIG. 1 to the second position shown in FIG. 4. The reverse movement could also be either clockwise or anticlockwise to move from the second position (FIG. 4) to the first position (FIG. 1). During the movement of the cap 18, the connector 14 will move in the axial direction with the circuit board 32 and/or cover 34. In this way, when the cap 18 is in the second position (FIG. 4) the connector is fully extended and can be used in the normal manner. When the cap 18 is in the first position (FIG. 1) the connector 14 is in a retracted position and is retracted within the housing 12 and its end 48 (as well as the opening 16) are covered by the end 24 of the cap 18. When the cap 18 is in the second position (FIG. 4) the connector 14 is in an extended position and extends through the opening 16 and axially outwardly from the housing 12 and can be used in the normal manner. In this way the connector 14 is fully protected when the cap 18 is in the first position. When in the retracted or first position, the end 48 of the connector 14 may be located within opening 16 in the end wall 17 and may not be withdrawn into the interior of housing 12. This therefore provides correct alignment of connector 14 and opening 16 at all times.

Sliders 46 may be provided on which the cover 34 moves to facilitate ease and accuracy of movement.

The cap 18 may have a cam or over-centre action when moving into and out of the first and second positions to provide tactile "feel" of engagement and disengagement respectively. This may be by selection of dimension such that the cap 18 requires a small force to pass over the corner edges of the side walls 25 of the housing 12 at the junction with the front and rear walls 17, 23. Additionally or alternatively, this may be given by the cover 34 or the circuit board 32 contacting the front and rear walls 17, 23 at the ends of its movement.

Figure 8:
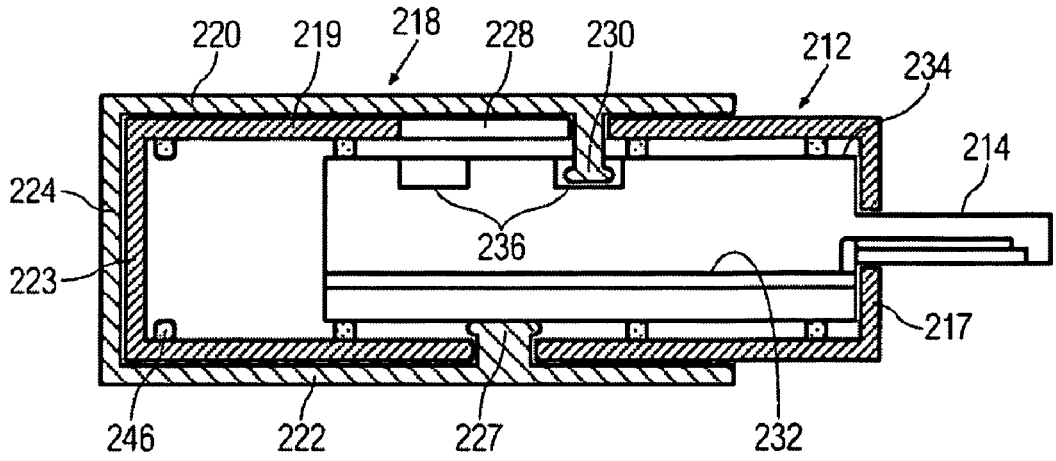
FIG. 8 is a view corresponding to FIG. 6 of another exemplary embodiment.
Figure 9:
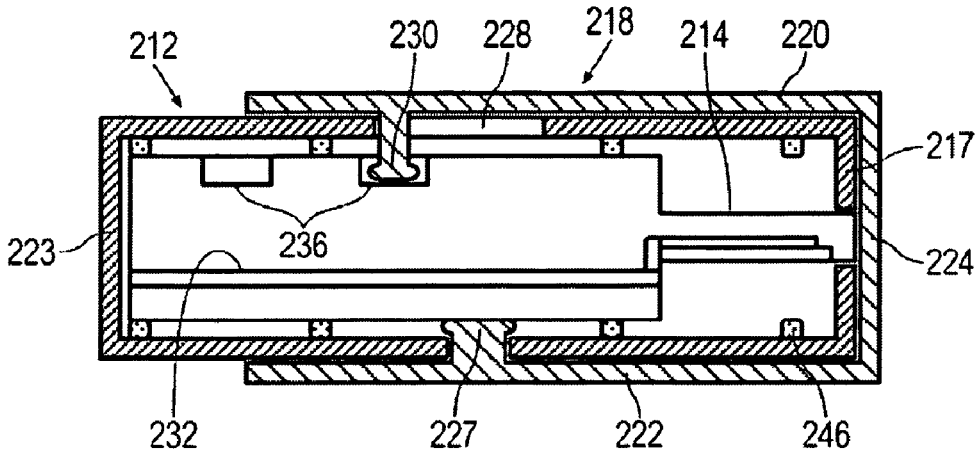
FIG. 9 is a view corresponding to FIG. 7 of the another exemplary embodiment.

FIGS. 8 and 9 show another exemplary embodiment where the same reference numerals are used for like components but with the addition of a prefix number 2.

In this embodiment the track the cap 218 has a pin 230 extending downwardly from a lower surface of the upper arm 220 of the cap 218 to the interior of the cover 234. The pin 230 forms the upper pivot connection of the cap 218 to the housing 212.

In this exemplary embodiment the form of the opening 228 and the track 236 is the reverse of that of the earlier exemplary embodiment. As such the pin 230 extends through at least one opening 228 in the top wall 219 of the housing 212 and engages in a track 236 formed in or on the top surface 244 of cover 234. If there is no cover, the track 236 would be in a member attached to the circuit board 232. The opening 228 is inclined to the central, longitudinal axis of the top wall 219 of the housing 212 at an angle that is preferably in the range 30° to 60°, more preferably being 45°. The track 28 will be arcuate and may cover an extended angle of movement to allow the cap to be moved between the first and second positions. Preferably, and as shown, the track 236 is an annular track that extends for 360°.

In this way, when the cap 218 is moved in a pivoting manner about the pivots 227 and 230, the pin 230 will slide along the opening 228 and press against the side walls of the track 236 and force the cover 234, or the circuit board 232, to move in the direction of the central, longitudinal axis of the cover 234. The opening 228 may be of a width greater than the width of the pin 230 to accommodate variations in the movement of the pin 230 as it travels along the opening 228. The pin 230 may have a bulbous head and track 236 may be undercut so that pin 230 engages in and is retained in the track 236. In this way the pin 230 acts as the upper pivot connection between the cap 218 and the housing 212. Therefore, a separate pivot pin 26 would not be required. However, one may be provided of required or desired.

During the movement of the cap 218, the connector 214 will move in the direction of the longitudinal axis with the circuit board 232 and/or cover 234. In this way, when the cap 218 is in the second position (FIG. 8) the connector is fully extended and can be used in the normal manner. When the cap 218 is in the first position (FIG. 9) the connector 214 is in a retracted position and is retracted within the housing 212 and its end 248 (as well as the opening 216) are covered by the end 224 of the cap 218. When the cap 218 is in the second position (FIG. 8) the connector 214 is in an extended position and extends through the opening 216 and axially outwardly from the housing 212 and can be used in the normal manner. In this way the connector 214 is fully protected when the cap 218 is in the first position. When in the retracted or first position, the end 248 of the connector 214 may be located within opening 216 in the end wall 217 and may not be withdrawn into the interior of housing 212. This therefore provides correct alignment of connector 214 and opening 216 at all times.

Whilst there has been described in the foregoing description preferred embodiments of the present invention, it will be understood by those skilled in the technology concerned that many variations in details of design, construction and/or operation may be made without departing from the present invention.

What is claimed:

1. Portable data storage apparatus comprising:

a housing having a front wall, and an opening in the front wall;

a circuit board located within the housing;

a connector electrically connected to the circuit board and extending outwardly therefrom for movement therewith;

a cap pivotally connected to the housing for movement relative to the housing between a first position and a second position; and an operating mechanism operatively connecting the cap and the circuit board, the operating mechanism being configured such that movement of the cap causes movement of the circuit board and the connector, the circuit board and the connector being in a retracted position when the cap is in the first position, and are in an extended position when the cap is in the second position.

2. Portable data storage apparatus as claimed in claim 1, wherein operating mechanism comprises at least one pin engaging in at least one track, the at least one pin passing through at least one opening in the housing.

3. Portable data storage apparatus as claimed in claim 2, wherein the circuit board is mounted within a cover, the connector being physically connected to at least one of: the circuit board, and the cover.

4. Portable data storage apparatus as claimed in claim 3, wherein the cover has a top surface, the top surface comprising the at least one track.

5. Portable data storage apparatus as claimed in claim 2, wherein the at least one track is at an angle of inclination to a central longitudinal axis of the housing.

6. Portable data storage apparatus as claimed in claim 5, wherein the angle of inclination is in the range 30° to 60°.

7. Portable data storage apparatus as claimed in claim 5 wherein the angle of inclination is 45°.

8. Portable data storage apparatus as claimed in claim 2, wherein the cap is generally U-shaped and comprises an upper arm pivotally connected to a top wall of the housing, a lower arm pivotally connected to a bottom wall of the housing, an end integral with and extending between the upper arm and the lower arm, and an open end.

9. Portable data storage apparatus as claimed in claim 8 wherein the at least one pin extends in a manner selected from the group consisting of: a first pin extending downwardly from the upper arm, a second pin extending upwardly from the lower arm, and the first pin extending downwardly from the upper arm and the second pin extending upwardly from the lower arm.

10. Portable data storage apparatus as claimed in claim 1, wherein when the connector is in the extended position, the connector passes through the opening in the front wall.

11. Portable data storage apparatus as claimed in claim 1, wherein when the connector is in the retracted position an outer end of the connector is located at one selected from the group consisting of; within the housing, in the opening in the front wall.

12. Portable data storage apparatus as claimed claim 1, wherein the housing further comprises a plurality of sliders on which the circuit board can slide between the retracted position and the extended position.

13. Portable data storage apparatus as claimed in claim 3, wherein the housing further comprises a plurality of sliders on which the cover can slide between the retracted position and the extended position.

14. Portable data storage apparatus as claimed in claim 1, wherein the connector is selected from the group consisting of: a USB connector, and an IEEE1394 connector; and the circuit board comprises non-volatile memory.

15. Portable data storage apparatus as claimed in claim 1, wherein the cap has a cam or over-centre action when moving into and out of the first and second positions for providing tactile feel of engagement and disengagement respectively.

16. Portable data storage apparatus as claimed in claim 15, wherein, in use, the cap requires a small force to pass over front corner edges at junctions of side walls of the housing with the front wall of the housing, and rear corner edges at junctions of the side walls of the housing with a rear wall of the housing.

17. Portable data storage apparatus claimed in claim 4, wherein the at least one track comprises an annular track.

18. Portable data storage apparatus as claimed in claim 17, wherein the annular track is undercut, the at least one pin having a bulbous head for engaging in and being retained by the annular track.

19. Portable data storage apparatus as claimed in claim 2, wherein the at least one pin forms a pivot connection between the cap and the housing.

* * * * *